US007748414B2

(12) United States Patent
Jenne

(10) Patent No.: US 7,748,414 B2
(45) Date of Patent: Jul. 6, 2010

(54) METHOD AND APPARATUS FOR THE INSERTION OF WEFT THREADS

(75) Inventor: Christoph Jenne, Zürich (CH)

(73) Assignee: Itema (Switzerland) Ltd, Wetzicon (CH)

( * ) Notice: Subject to any disclaimer, the term of this patent is extended or adjusted under 35 U.S.C. 154(b) by 0 days.

(21) Appl. No.: 11/638,102

(22) Filed: Dec. 12, 2006

(65) Prior Publication Data

US 2008/0135125 A1 Jun. 12, 2008

(51) Int. Cl.
*D03D 47/30* (2006.01)
*D03D 23/00* (2006.01)

(52) U.S. Cl. ..... 139/435.1; 139/435.2; 139/435.3; 139/435.4; 139/435.5

(58) Field of Classification Search .... 139/435.1–435.6
See application file for complete search history.

(56) References Cited

U.S. PATENT DOCUMENTS 3,137,322 A * 6/1964 Te Strake ..... 139/435.1
3,367,371 A * 2/1968 Van Mullekom ..... 139/435.4
3,370,617 A * 2/1968 Te Strake ..... 139/435.4
3,384,128 A * 5/1968 Fransen ..... 139/435.4
3,451,437 A * 6/1969 Van Mullekom ..... 139/435.4
3,519,030 A * 7/1970 Vermeulen ..... 139/435.4
4,096,889 A * 6/1978 Larmit ..... 139/435.1
4,133,353 A * 1/1979 Larmit ..... 139/435.1
4,178,971 A * 12/1979 Malasek et al. ..... 139/435.1
4,290,459 A * 9/1981 Manders ..... 139/435.4
4,326,565 A * 4/1982 Van Mullekom ..... 139/435.4
4,404,996 A * 9/1983 Manders ..... 139/194
4,436,122 A * 3/1984 van Mullekom ..... 139/435.4
4,476,903 A * 10/1984 Gunneman ..... 139/435.4
4,550,752 A * 11/1985 Manders ..... 139/435.4
4,552,188 A * 11/1985 Kuda et al. ..... 139/435.4
4,565,226 A * 1/1986 Tsuji ..... 139/435.3
4,572,246 A * 2/1986 Ghiaro ..... 139/435.3
4,590,972 A * 5/1986 Sugita et al. ..... 139/435.2
4,619,296 A * 10/1986 Hrus et al. ..... 139/435.4
4,640,318 A * 2/1987 Hintsch et al. ..... 139/439
4,643,233 A * 2/1987 Manders ..... 139/435.4
4,644,980 A * 2/1987 Mitsuya et al. ..... 139/435.4

(Continued)

FOREIGN PATENT DOCUMENTS

DE 3716602 C1 * 6/1988

(Continued)

OTHER PUBLICATIONS

Derwent abstract 2006-001064, Gielen, corresponds to DE 102004036996.*

*Primary Examiner*—Bobby H Muromoto, Jr.
(74) *Attorney, Agent, or Firm*—Townsend and Townsend and Crew, LLP

(57) ABSTRACT

An apparatus (1) for the insertion of weft threads in a weaving machine is presented. The apparatus includes a nozzle holder (9) and, secured thereto, at least one nozzle (3) with a mixing tube (6) for the insertion of a weft thread (2) as well as a clamping device (7) which can be charged with a medium in order to firmly clamp a weft thread which is introduced into the nozzle. In addition the apparatus (1) contains at least one control valve (8) which is arranged at or in the nozzle holder (9) or nozzle (3) in order to control the clamping device (7).

11 Claims, 4 Drawing Sheets

U.S. PATENT DOCUMENTS

| | | | | | |
|---|---|---|---|---|---|
| 4,646,791 | A | * | 3/1987 | Tsuji et al. | 139/435.2 |
| 4,669,514 | A | * | 6/1987 | Manders | 139/435.3 |
| 4,691,745 | A | * | 9/1987 | Takekawa et al. | 139/435.4 |
| 4,756,342 | A | * | 7/1988 | Van Bogaert | 139/435.3 |
| 4,813,460 | A | * | 3/1989 | Van Bogaert et al. | 139/435.4 |
| 4,848,416 | A | * | 7/1989 | Tholander | 139/435.2 |
| 4,903,739 | A | * | 2/1990 | Tacq | 139/435.3 |
| 4,905,741 | A | * | 3/1990 | Wahhoud et al. | 139/435.6 |
| 4,936,353 | A | * | 6/1990 | Volland et al. | 139/194 |
| 5,016,679 | A | * | 5/1991 | Cox | 139/450 |
| 5,111,852 | A | * | 5/1992 | Verhulst | 139/435.4 |
| 5,226,458 | A | * | 7/1993 | Bamelis | 139/194 |
| 5,417,250 | A | * | 5/1995 | Markey | 139/435.3 |
| 5,526,850 | A | * | 6/1996 | Sora et al. | 139/435.4 |
| 5,570,726 | A | * | 11/1996 | Wahhoud et al. | 139/434 |
| 5,606,998 | A | * | 3/1997 | Wahhoud et al. | 139/194 |
| 5,697,405 | A | * | 12/1997 | Dornier et al. | 139/435.4 |
| 6,050,304 | A | * | 4/2000 | Schiller et al. | 139/435.3 |
| 6,223,783 | B1 | * | 5/2001 | Peeters et al. | 139/435.4 |
| 6,370,746 | B1 | * | 4/2002 | Hinchliffe et al. | 28/273 |
| 6,497,257 | B1 | * | 12/2002 | Allen et al. | 139/450 |
| 7,537,029 | B2 | * | 5/2009 | Gielen et al. | 139/435.1 |
| 2008/0135125 | A1 | * | 6/2008 | Jenne | 139/435.2 |
| 2008/0156390 | A1 | * | 7/2008 | Gielen et al. | 139/435.4 |

FOREIGN PATENT DOCUMENTS

| | | | | |
|---|---|---|---|---|
| DE | 22917872 | U1 | | 1/2000 |
| DE | 10135446 | A1 | | 2/2003 |
| DE | 102004036996 | | * | 8/2005 |
| WO | WO 02/095105 | A1 | | 11/2002 |

* cited by examiner

METHOD AND APPARATUS FOR THE INSERTION OF WEFT THREADS

BACKGROUND OF THE INVENTION

The invention relates to an apparatus for the insertion of weft threads in a weaving machine and to a method for the insertion of weft threads in a weaving machine as well as to a weaving machine with an apparatus of this kind and for carrying out a method of this kind.

In DE 32 00 638 A1 an air jet weaving machine is described which comprises a nozzle with a mixing tube for the insertion of weft threads and a reed for beating up the latter. A thread clamp is arranged in the mixing tube of the nozzle in order to firmly clamp the weft thread during the severing or during the standstill of the weaving machine and thereby to prevent a jumping back of the weft thread in the nozzle. This arrangement of the thread clamp permits arranging the mixing tube close to a weft thread guiding passage which is formed in the reed, so that during the insertion the deviation in the desired position of the weft thread between the mixing tube and the weft thread guiding passage can be kept small.

WO 02095105 A1 discloses, in FIGS. 5 and 6 of the specification, an apparatus for the insertion of weft threads in a weaving machine which contains a plurality of nozzles, each with a mixing tube. The nozzles are each provided with a clamping device 1A which are connected via lines 15 to control valves 17 in order to charge the clamping devices with compressed air or vacuum. The control valves 17 are activated by a control system 20.

In the conventional apparatuses for the insertion of weft threads the latter are held firmly in the individual nozzles after the insertion by means of a retaining air flow in normal operation in order to prevent a jumping back of the weft threads in the nozzles. In contrast, when the weaving machine is stopped, the weft threads are held firmly by clamping devices which are arranged in the mixing tube of the nozzles; and the retaining air flow is interrupted since there is the danger when the machine stands still for a longer period of time that the weft threads will be damaged by the retaining air flow. The clamping devices have the disadvantage however that they complicate the threading in of individual weft threads into the associated nozzles, since the clamping devices must be opened individually via the weaving machine control system for the threading in. The individual control of the clamping devices is connected with additional cost and complexity since in addition to one control valve per clamping device a supply line for the compressed air is also needed.

SUMMARY OF THE INVENTION

An object of the present invention is to make available an apparatus for the insertion of weft threads in a weaving machine which has a lower cost and complexity in comparison with conventional apparatuses as well as a method which simplifies the threading of a weft thread into a nozzle. A further object of the invention consists in making available a weaving machine with an apparatus of this kind for the insertion of weft threads or for carrying out a method of this kind.

These objects are satisfied in accordance with the invention by the methods, apparatus, and weaving machine for the insertion of weft threads which is described herein.

The apparatus in accordance with the invention for the insertion of weft threads in a weaving machine includes a nozzle holder and, secured thereto, at least one nozzle with a mixing tube for the insertion of a weft thread as well as at least one clamping device which can be charged with a medium and which is arranged in the region of the nozzle in order to firmly clamp a weft thread which is introduced into the nozzle. In addition the apparatus contains at least one control valve which is arranged at or in the nozzle holder or nozzle or clamping device and which is in connection with the clamping device in order to control the charging of the clamping device.

In a preferred embodiment the at least one control valve is additionally connected to the at least one nozzle in order to charge the latter with a medium for threading in a weft thread. In a preferred variant the charging of both the at least one nozzle and also of the at least one clamping device can be controlled by means of the at least one control valve in order to switch over between the charging of the nozzle for the threading and the firm clamping of the weft thread. The at least one control valve is preferably formed as a manually operated control valve.

In a further preferred embodiment the apparatus contains a plurality of nozzles, with a clamping device and a control valve, which is arranged at or in the nozzle holder or nozzle, being provided for each nozzle. The apparatus preferably comprises a common supply line in order to supply the apparatus with the medium which is used for charging the clamping devices and/or for the threading in.

In a further preferred embodiment the connection between the at least one control valve and the at least one clamping device is formed in the interior of the nozzle holder and/or in the interior of the at least one nozzle or clamping device.

Furthermore, the invention includes a method for the insertion of weft threads in a weaving machine by means of an apparatus which contains a nozzle holder and, secured thereto, at least one nozzle with a mixing tube. In the method the at least one nozzle is charged with a medium for threading in a weft thread and the weft thread is introduced; the weft thread which is introduced into the nozzle is firmly clamped by means of at least one clamping device which is charged with a medium for this purpose; the clamping of the weft thread is released prior to the insertion and the latter is inserted by means of the nozzle. In addition, the charging of the nozzle for the threading in and/or the clamping device for the firm clamping is controlled in the method by at least one control valve which is arranged at or in the nozzle holder or nozzle or clamping device.

In a preferred variant a switchover is carried out by means of the at least one control valve between charging the at least one nozzle for the threading in and the firm clamping of the weft thread.

Furthermore, the invention comprises a weaving machine with an apparatus for the insertion of weft threads in accordance with any one of the above-described embodiments and/or equipped for carrying out a method in accordance with the above description.

The apparatus in accordance with the invention and the method in accordance with the invention for the insertion of weft threads have the advantage that the threading in of a weft thread is simplified by the control valve which is attached to the nozzle holder or nozzle or clamping device, for example in that the control valve is actuated by hand during the threading in. A further advantage is that when the apparatus comprises a plurality of nozzles, the apparatus can be supplied via a single supply line with the medium which is used for charging the clamping devices and/or for the threading in.

The above description of embodiments serves merely as an example. Further advantageous embodiments are described herein and shown in the drawings. Moreover, in the context of the present invention individual features from the described or illustrated embodiments and their variants can also be combined with one another to form new embodiments.

The invention will be explained in the following in more detail with reference to the exemplary embodiment and with reference to the drawings.

DESCRIPTION OF THE PREFERRED EMBODIMENTS

Figure 1:
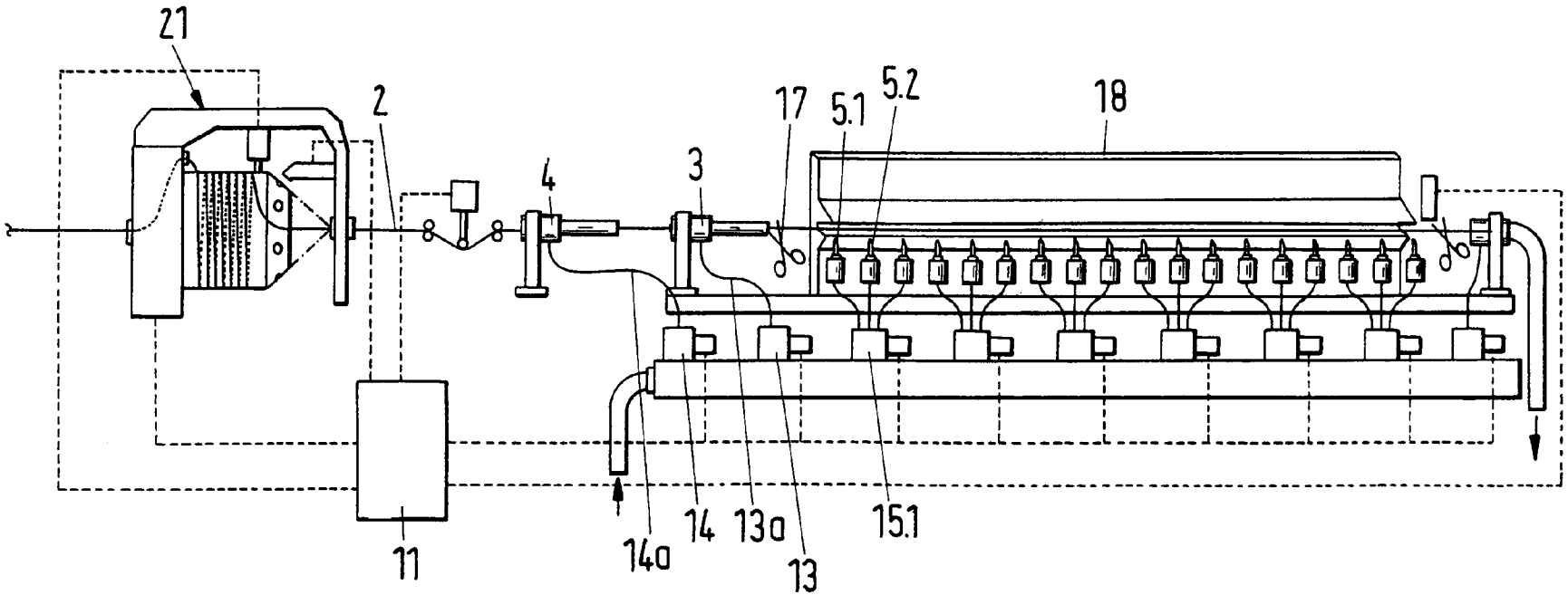
FIG. 1 is a schematic view of a conventional air jet weaving machine.

In the view of a conventional air jet weaving machine which is shown in FIG. 1 the weaving machine comprises a thread storage 21 for the provision of a weft thread 2, a plurality of air nozzles 3, 4, 5.1, 5.2, a control system 11 which is connected to control valves 13, 14, 15.1, and supply lines 13, 14 which connect the control valves to the corresponding air nozzles in order to charge the air nozzles with a medium, for example with compressed air, for the insertion of the weft thread. The air nozzles comprise for example a tandem nozzle 4 and a main nozzle 3 in order to accelerate the weft thread 2 which is drawn off from the thread storage 21 and to blow it into a shed, and relay nozzles 5.1, 5.2 in order to transport the weft thread further in the shed. In place of the tandem and main nozzles 3, 4 it is also possible to provide only a single main nozzle 3 in order to accelerate the weft thread or, depending on the application, a large number of main nozzles 3 in order to accelerate and insert different weft threads 2, which can differ in color, fineness, texture and material. Furthermore, the illustrated weaving machine comprises a reed 18 in order to beat up the inserted weft thread and at least one severing device 17 in order to cut off the weft thread. The main nozzle 3, the relay nozzles 5.1, 5.2 and the reed 18 can be secured to a common sley.

Figure 2A:
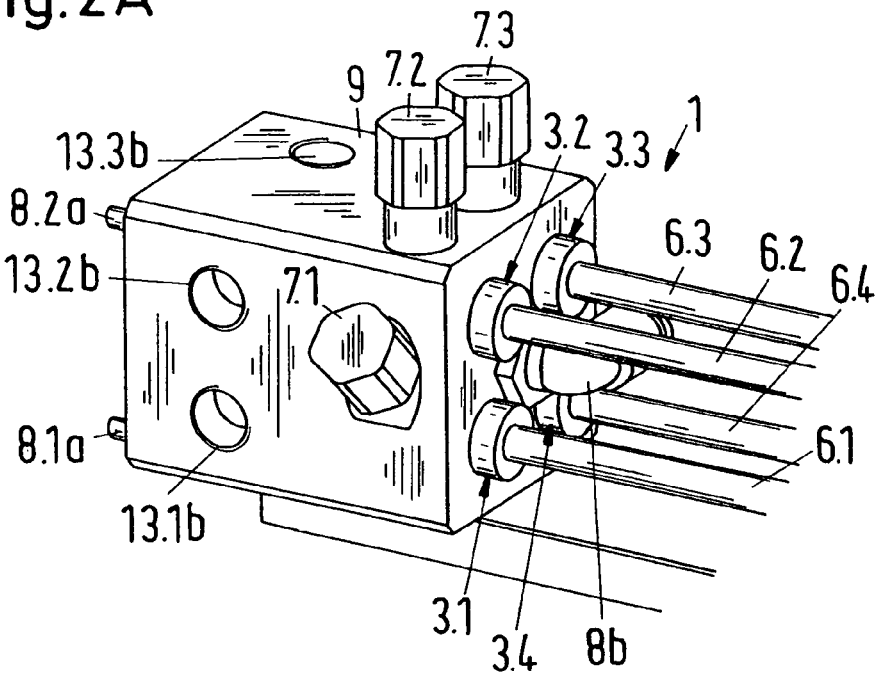
FIG. 2A is a perspective view of an exemplary embodiment of an apparatus for inserting weft threads in accordance with the present invention.

FIG. 2A shows a perspective view of an exemplary embodiment of an apparatus 1 for inserting weft threads in accordance with the present invention. The apparatus comprises a nozzle holder 9 and, secured thereto, at least one nozzle 3.1-3.4 with a mixing tube 6.1-6.4 for inserting a weft thread 2 as well as at least one clamping device 7.1-7.3 which can be charged with a medium and which is arranged in the region of the nozzle in order to firmly clamp a weft thread which is introduced into the nozzle. In the exemplary embodiment which is shown in FIG. 2A the apparatus comprises four nozzles 3.1-3.4, each with a mixing tube 6.1-6.4 and a clamping device 7.1-7.3, with the fourth clamping device being hidden by the nozzle holder 9. The number of nozzles in the apparatus can be freely chosen within a wide range, so that the apparatus can comprise for example one, two, three, four, five, six or more nozzles. The apparatus in accordance with the invention also comprises at least one control valve which is arranged at or in the nozzle holder 9 or nozzle 3.1-3.4 or clamping device 7.1-7.3 and which is in connection with the clamping device 7.1-7.3 in order to control the charging of the latter with the medium. In the exemplary embodiment which is illustrated the apparatus 1 comprises for each of the four nozzles 3.1-3.4 a control valve which is arranged in the nozzle holder 9. Of the four control valves, only the actuating buttons or keys 8.1*a*, 8.2*a* of two control valves are visible in FIG. 2A.

In one variant, openings 13.1*b*-13.3*b* are provided in the nozzle holder or in the nozzles, for example for inserting screw connections for supply lines in order to be able to charge the nozzles with a medium for accelerating and inserting the weft threads.

In an advantageous embodiment the apparatus in accordance with the invention comprises a plurality of nozzles 3.1-3.4, each with a clamping device 7.1-7.3 and a control valve for each nozzle as well as a common supply line 8*b* in order to be able to supply the apparatus with the medium which is used for charging the clamping devices.

In a further advantageous embodiment the connection between the at least one control valve and the at least one clamping device 7.1-7.3 is formed in the interior of the nozzle holder 9 and/or in the interior of the at least one nozzle 3.1-3.4 and/or clamping device 7.1-7.3.

Figure 2B:
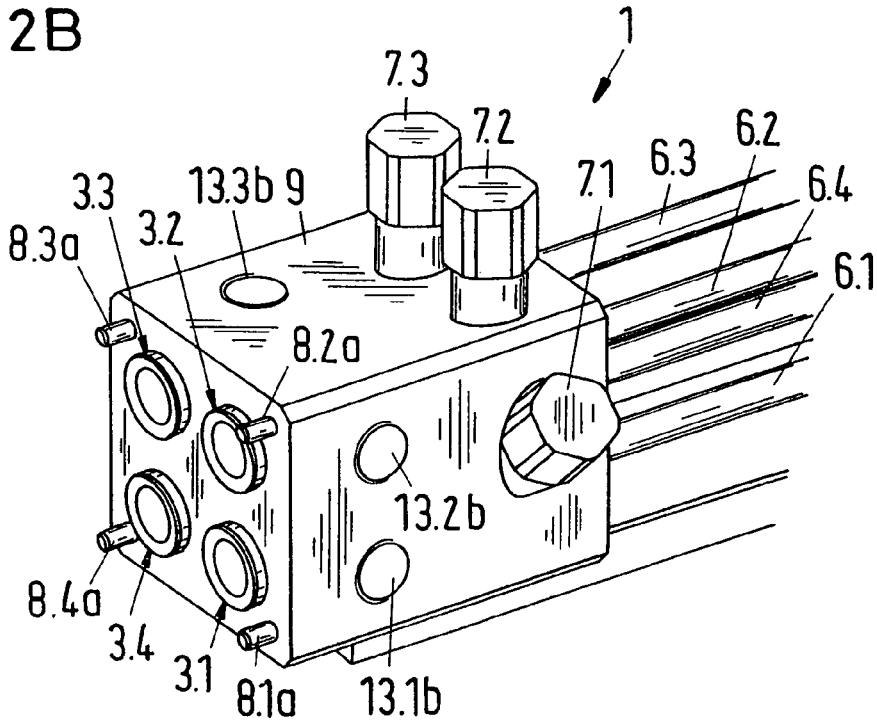
FIG. 2B is a perspective view of the exemplary embodiment which is shown in FIG. 2A from another angle of view.

FIG. 2B shows a perspective view of the exemplary embodiment of FIG. 2A from another angle of view. In the illustrated exemplary embodiment the apparatus 1 comprises a nozzle holder 9 and, let into the latter, four nozzles 3.1-3.4, each with a mixing tube 6.1-6.4 and a clamping device 7.1-7.3, in order to firmly clamp a weft thread which is introduced into the respective nozzle, with the fourth clamping device being hidden by the nozzle holder 9. Furthermore, the apparatus 1 comprises a control valve for each of the four nozzles 3.1-3.4 which is arranged in the nozzle holder 9. Only the actuating buttons 8.1*a*-8.4*a* of the four control valves are visible in FIG. 2A. In one variant, openings 13.1*b*-13.3*b* are provided in the nozzle holder 9 in order to be able to charge the nozzles with a medium for accelerating and inserting the weft threads.

Figure 3A:
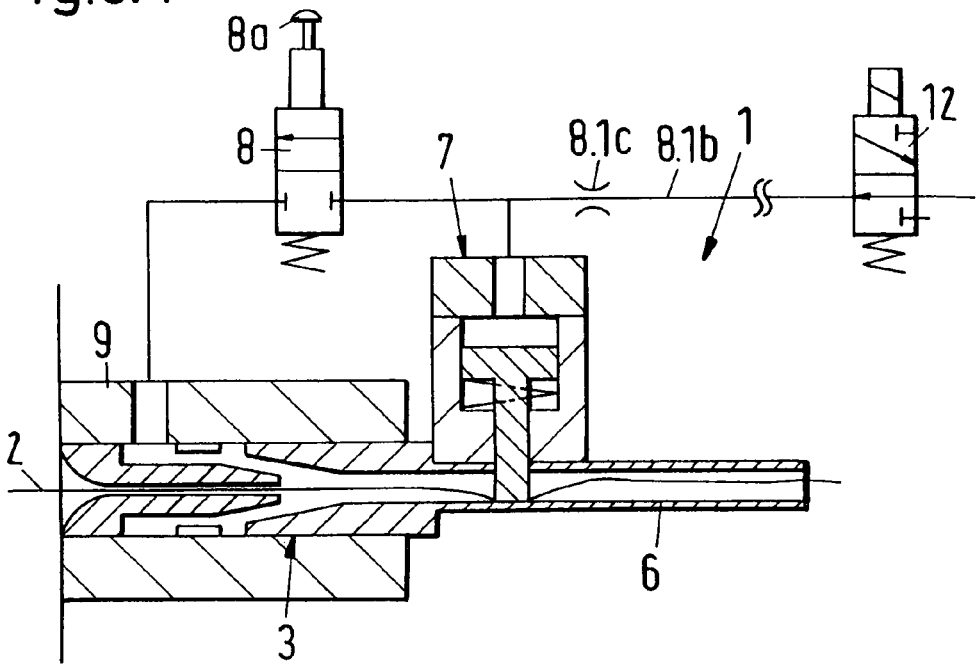
FIG. 3A is a schematic illustration of a second exemplary embodiment of an apparatus in accordance with the present invention with the weft thread in the firmly clamped state.

FIG. 3A shows a schematic illustration of a second exemplary embodiment of an apparatus in accordance with the present invention with the weft thread in the firmly clamped state. In the illustrated exemplary embodiment the apparatus 1 comprises a nozzle holder 9 and, secured thereto, a nozzle 3 with a mixing tube 6 for the insertion of a weft thread 2 as well as a clamping device 7 which can be charged with a medium and which is arranged in the region of the nozzle. In FIG. 3A the nozzle and the clamping device are illustrated in section, so that their construction is visible. The clamping device 7 can for example contain a piston which can be charged with the medium and a pressing bolt which is connected to the piston or a membrane in order to press the weft thread against a rest, e.g. a wall of the mixing tube, and to clamp it firmly. The clamping device can furthermore contain a resetting spring for resetting the piston.

In addition the apparatus 1 of the second exemplary embodiment comprises a control valve 8, e.g., as shown in FIG. 3A, a so-called 2/2-way valve, which is arranged at or in the nozzle holder 9 or nozzle 3 or clamping device 7, which is termed an internal control valve in the context of this exemplary embodiment and which can for example be actuated by a manual button 8*a*. In the illustrated exemplary embodiment the internal control valve 8 is connected at the input side to the clamping device 7 and to a supply line 8.1*b* of the apparatus 1 into which a fixed or adjustable restrictor element 8.1*c* can be inserted when required in order to be able to limit the amount of the medium flowing through. If the internal control valve 8 is closed, as shown in FIG. 3A, the clamping device is charged with the full pressure of the medium in the supply line 8.1*b* and the weft thread 2 is firmly clamped.

In an advantageous variant the apparatus in accordance with the invention includes at least one further control valve 12, for example a 3/2-way valve, which will be designated in the following as an external control valve and which, e.g., can be controlled by the control system of the weaving machine in order to charge the supply line 8.1*b* with pressure and/or to depressurize it. During a standstill of the weaving machine the supply line 8.1*b* and thereby the clamping device 7 can be charged with pressure via the external control valve 12 in order to firmly clamp the weft thread 2, whereas during operation of the weaving machine and/or during a weft insertion the supply line 8.1*b* can be depressurized via the external control valve 12 in order to be able to release the clamping of the weft thread. If required, the supply lines of a plurality of apparatuses can be connected to the output of the external control valve 12 in order to control the clamping of a plurality of weft threads via the same control valve.

Figure 3B:
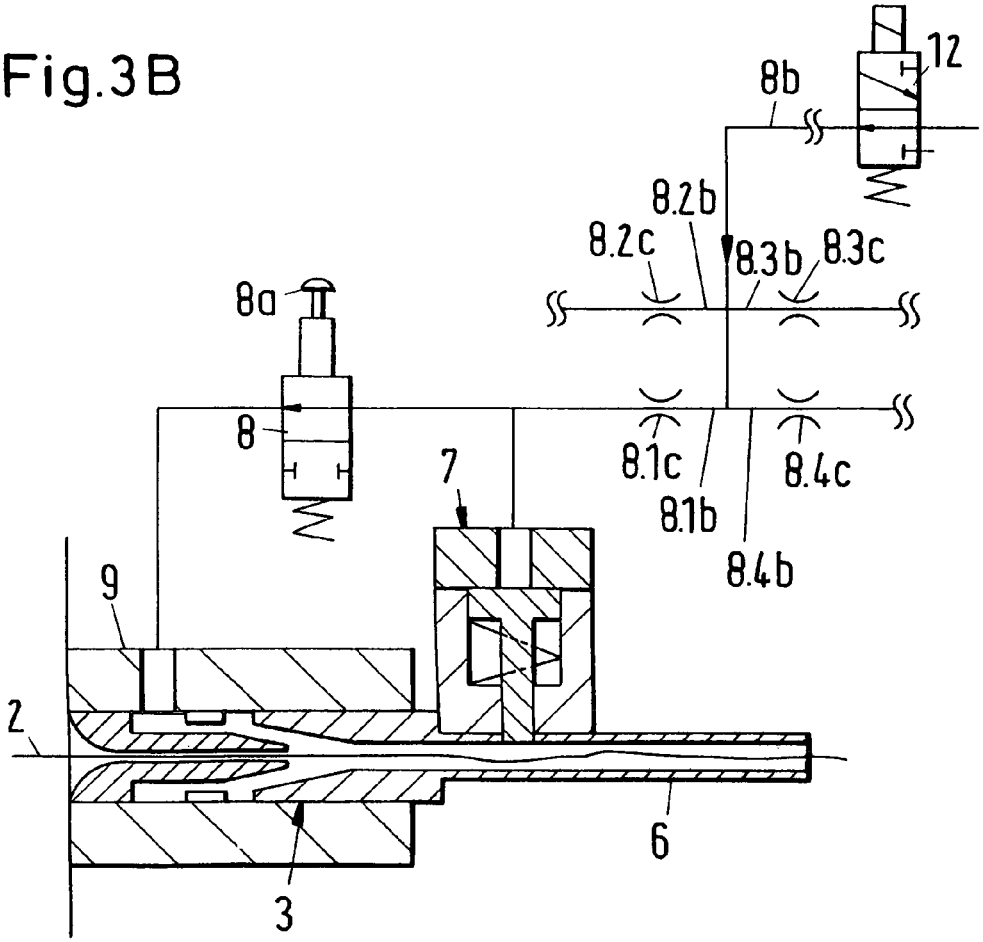
FIG. 3B is a schematic illustration of a preferred embodiment of the second exemplary embodiment during the threading in of the weft thread.

In an advantageous embodiment the internal control valve 8, which is arranged at or in the nozzle holder 9 or nozzle 3 or clamping device 7, is connected at the output side to the nozzle 3, so that the latter can be charged with medium for the threading in of a weft thread. FIG. 3B shows a schematic illustration of an embodiment of this kind during the threading in of the weft thread. As already described in the discussion of FIG. 3A, the internal control valve 8 is connected at the input side to the clamping device 7 and the supply line 8.1*b* of the apparatus 1. If the internal control valve 8 and where appropriate the external control valve 12 are opened, as shown in FIG. 3B, the nozzle 3 is charged with the medium which is supplied via the supply line 8.1*b*, with the amount flowing through being limited by a flow resistance in the supply line, for example by the illustrated restrictor element 8.1*c*. As a result of the flow resistance in the supply line the pressure of the medium with which the clamping device 7 is charged drops to such an extent that the latter is opened, for example by a correspondingly designed resetting spring, and frees the way for the weft thread 2. The weft thread can now be introduced into the nozzle 3 with the assistance of the medium which is supplied for the threading in.

In a further advantageous embodiment the apparatus 1 contains a plurality of nozzles 3, with a clamping device 7 and an internal control valve 8 which is arranged at or in the nozzle holder 9 or nozzle 3 or clamping device 7 being provided for each nozzle. The apparatus advantageously includes a common supply line 8*b* in order to be able to supply the apparatus with the medium which is used for charging the clamping devices and/or for the threading in. FIG. 3B shows a common supply line 8*b* of this kind which is connected to individual supply lines 8.1*b*-8.4*b* in order to be able to supply the medium to the respective internal control valves 8 and clamping devices 7. Restrictor elements 8.1*c*-8.4*c* which limit the amount flowing through are inserted into the individual supply lines 8.1*b*-8.4*b*, as described in the discussion of FIG. 3B. Due to the restrictor elements the pressure of the medium in the common supply line 8*b* falls only slightly when one of the internal control valves is opened, so that only the clamping device which belongs to the relevant control valve is opened, whereas the remaining clamping devices maintain their clamping of the weft thread. Since normally only one weft thread is threaded in at a time or, respectively, only one control valve is opened at a time, the number of nozzles in the apparatus 1 is not critical.

In an advantageous variant a further control valve 12 is provided, for example a 3/2-way valve, which will be termed an external control valve in the following and which, e.g., can be controlled by the weaving machine in order to charge the common supply line 8*b* with pressure or to depressurize it. During a standstill of the weaving machine the supply line 8*b* can be charged with pressure via the external control valve 12 in order to be able to firmly clamp the associated weft thread 2, whereas during operation of the weaving machine and/or during the weft insertions the supply line 8*b* can be depressurized via the external control valve 12 in order to release the clamping of the weft threads.

In an advantageous variant the connections between the common supply line 8*b* and the individual supply lines 8.1*b*-8.4*b* and/or the individual supply lines 8.1*b*-8.4*b* themselves and/or the connections to the restrictor elements 8.1*c*-8.4*c* and/or to the internal control valves 8 and/or to the clamping devices 7 and/or to the nozzles 3 are formed in the interior of the nozzle holder 9 and/or of the nozzles 3 and/or of the clamping devices 7, for example as bores. In a further advantageous variant the internal control valves and, in certain cases, the restrictor elements are integrated into the nozzle holder 9 and/or into the nozzles 3 and/or into the clamping devices 7. The common supply line for the medium for the threading in of and/or the firm clamping of the weft threads and the arrangement of the individual supply lines in the interior of the nozzle holder and/or nozzles enable savings to be made in the manufacture of the apparatus.

Figure 4A:
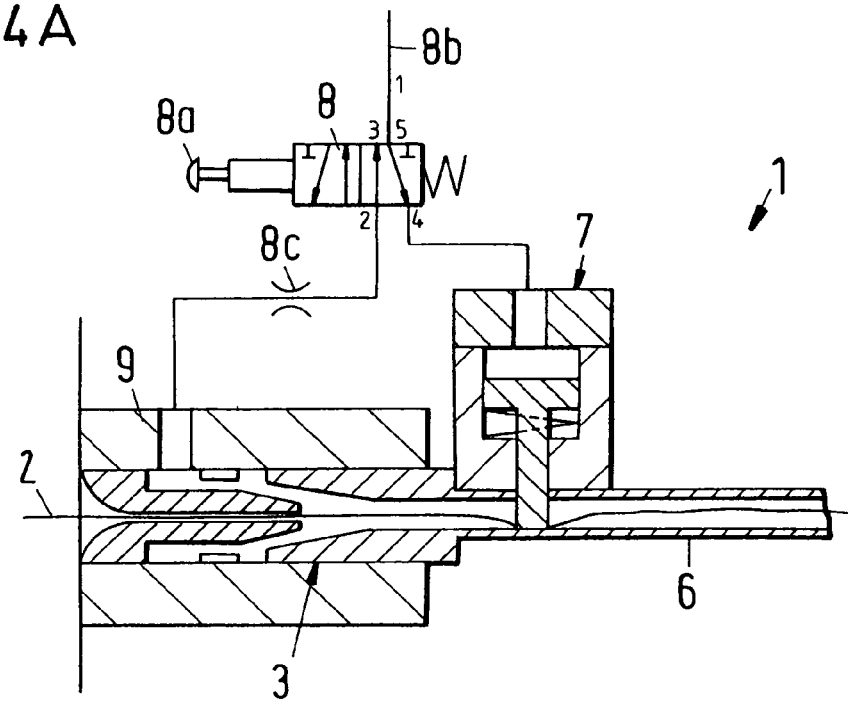
FIG. 4A is a schematic illustration of a third exemplary embodiment of an apparatus in accordance with the present invention with the weft thread in the firmly clamped state.

FIG. 4A shows a schematic illustration of a third exemplary embodiment of an apparatus in accordance with the present invention with the weft thread in the firmly clamped state. In the illustrated exemplary embodiment the apparatus 1 comprises a nozzle holder 9 and, secured thereto, a nozzle 3 with a mixing tube 6 for the insertion of a weft thread 2 as well as a clamping device 7 which can be charged with a medium and which is arranged in the region of the nozzle. In addition the apparatus 1 of the third exemplary embodiment comprises a control valve 8, e.g. a 2/2-way valve or a 2/3-way valve or, as shown in FIG. 4A, a so-called 5/2-way valve, which is arranged at or in the nozzle holder 9 or nozzle 3 or clamping device 7 and which can for example be actuated by a manual button 8*a*. In the illustrated exemplary embodiment the control valve 8 is connected at the input side to a supply line 8*b* of the apparatus 1 and via an output to the clamping device 7. If the control valve 8 is in a position, as shown in FIG. 4A, in which the input is connected to the output which leads to the clamping device, the clamping device is charged with the pressure of the medium in the supply line 8*b* and the weft thread 2 is firmly clamped.

Figure 4B:
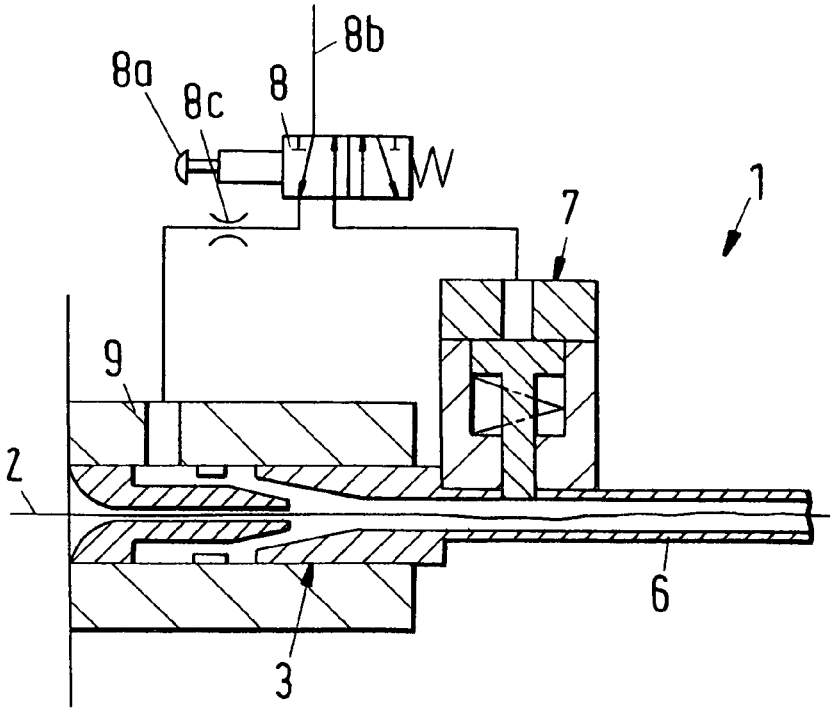
FIG. 4B is a schematic illustration of the third exemplary embodiment during the threading in of the weft thread.

In an advantageous embodiment the control valve 8 is designed as a 5/2-way valve and is connected via a second output to the nozzle 3, so that the latter can be charged with medium for the threading in of a weft thread. If required, a fixed or adjustable restrictor element 8*c* can be provided between the control valve and the nozzle in order to be able to adapt the amount of the medium which flows through for the threading in. FIG. 4B shows a schematic illustration of an embodiment of this kind during the threading in of the weft thread. The control valve 8 is, as already described in the discussion of FIG. 4A, connected at the input side to the supply line 8*b* of the apparatus 1 and is connected via one output to the clamping device 7 as well as via a second output to the nozzle 3, with it being possible for a restrictor element 8*c* to be provided ahead of the nozzle. If the control valve 8 is in a position, as shown in FIG. 4B, in which the input is connected to the output which leads to the nozzle, the nozzle 3 is charged with the medium which is supplied via the supply line 8*b* and where appropriate via the restrictor element 8*c*. At the same time the output which leads to the clamping device is connected to a depressurizing opening in this position of the control valve, so that a pressure which charges the clamping device 7 drops to ambient pressure, whereupon the clamping device is opened, for example by a correspondingly designed resetting spring, and frees the way for the weft thread 2. The weft thread can now be introduced into the nozzle 3 with the assistance of the medium which is supplied for the threading in.

In a further advantageous embodiment the apparatus 1 contains a plurality of nozzles 3, with a clamping device 7 and a control valve 8 which is arranged at or in the nozzle holder 9 or nozzle 3 or clamping device 7 being provided for each nozzle. The apparatus advantageously comprises a common supply line 8*b* in order to be able to supply the apparatus with the medium which is used for charging the clamping devices and/or for the threading in. In an advantageous variant the control valves and where appropriate the restrictor elements are integrated into the nozzle holder 9 and/or into the nozzles 3 and/or into the clamping devices 7.

An exemplary embodiment of the method in accordance with the invention for the insertion of weft threads in a weaving machine will be described in the following with reference to FIGS. 4A and 4B. The insertion of the weft threads and, in connection therewith, the threading in and firm clamping of the weft threads takes place in this exemplary embodiment by means of an apparatus 1 which comprises a nozzle holder 9 and, secured thereto, at least one nozzle 3 with a mixing tube 6. In the exemplary embodiment the at least one nozzle is first charged with a medium for threading in a weft thread 2 and the weft thread is introduced; and the weft thread which is introduced into the nozzle is firmly clamped by means of at least one clamping device 7 which is charged with a medium for this purpose. Prior to the insertion the clamping of the weft thread is released and the latter is inserted by means of the nozzle. In this process the charging of the nozzle 3 for the threading in and/or of the clamping device 7 for the firm clamping is controlled by at least one control valve 8 which is arranged at or in the nozzle holder 9 or nozzle 3 or clamping device 7. In an advantageous variant the control valve 8 is actuated by hand.

In a further advantageous variant of the method a switchover between the charging of the at least one nozzle for the threading in and the firm clamping of the weft thread is carried out by means of the at least one control valve 8. For this purpose a 2/2-way valve can, for example, be provided in the apparatus which e.g. can be used in the manner which was described in the discussion of the FIGS. 3A and 3B; or a 5/2-way valve can be provided, which can, e.g., be used in the manner which is described in the discussion of the FIGS. 4A and 4B.

The apparatus in accordance with the invention and the method in accordance with the invention for the insertion of weft threads in a weaving machine simplify the threading in of a weft thread in that, for example, the control valve which is attached to the nozzle holder or nozzle can be actuated with the one hand, while the weft thread is introduced into the corresponding nozzle with the other hand. It is furthermore advantageous that the apparatus can be supplied via a single supply line with the medium which is used for the charging of the clamping devices and/or for the threading in. The common supply line for the medium for the threading in and/or the firm clamping of the weft threads enables an economical manufacture of the apparatus and an economical installation of the latter into the weaving machine.

What is claimed is:

1. An apparatus for the insertion of weft threads in a weaving machine, said apparatus including a nozzle holder and, secured thereto, a plurality of nozzles, with a mixing tube for the insertion of a weft thread, at least one clamping device and at least one control valve being provided for each of the nozzles, wherein the clamping device is able to be charged with a medium, is arranged in the region of the nozzle and includes a clamping part and a rest for pressing the weft thread with the clamping part against the rest in order to firmly clamp a weft thread which is introduced into the nozzle, and wherein the at least one control valve provided for each of the nozzles is arranged at or in the nozzle holder or nozzle or clamping device and which is in connection with the clamping device of the respective nozzle in order to control the charging of the clamping device with the medium.

2. An apparatus in accordance with claim 1, wherein the at least one control valve is additionally connected to the at least one nozzle in order to charge the latter with a medium for the insertion of a weft thread.

3. An apparatus in accordance with claim 2, wherein the charging of both the at least one nozzle and the at least one clamping device is controllable by the at least one control valve in order to switch between the charging of the nozzle for the threading and of the clamping device for the clamping of the weft thread.

4. An apparatus in accordance with claim 1, wherein the at least one control valve is operable by hand.

5. An apparatus in accordance with claim 1, additionally including a common supply line to supply the apparatus with the medium which is used to charge the clamping devices and/or for the threading in.

6. An apparatus in accordance with claim 1, wherein the connection between the at least one control valve and the at least one clamping device is in the interior of the nozzle holder and/or in the interior of the at least one nozzle and/or in the interior of the at least one clamping device.

7. An apparatus in accordance with claim 1, additionally comprising a weaving machine for receiving the well thread.

8. A method for the insertion of well threads in a weaving machine by an apparatus, with the apparatus including a nozzle holder and, secured thereto, a plurality of nozzles, comprising:

threading a well thread into one of the nozzles, the nozzle being charged with a medium;

clamping the well thread firmly in the nozzle using a mechanical clamping device of the apparatus and charging the clamping device with the medium;

inserting the well thread into the weaving machine after releasing the well thread in the nozzle; and wherein the charging of the nozzle for the threading and/or of the clamping device for the firm clamping is controlled by at least one control valve which is arranged at or in the nozzle holder or nozzle or clamping device.

9. A method in accordance with claim 8, additionally comprising switching charging of the medium between the nozzle and the clamping device using the at least one control valve.

10. An apparatus in accordance with claim 1, wherein the clamping part is a piston or a membrane.

11. An apparatus in accordance with claim 10, wherein the clamping device includes a spring for resetting the piston or membrane.

* * * * *